US008919256B1

(12) United States Patent
Geswender et al.

(10) Patent No.: US 8,919,256 B1
(45) Date of Patent: Dec. 30, 2014

(54) OBTURATOR RING WITH INTERLOCKING SEGMENTS

(71) Applicant: Raytheon Company, Waltham, MA (US)

(72) Inventors: Chris E. Geswender, Green Valley, AZ (US); Rick Williams, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 86 days.

(21) Appl. No.: 13/737,249

(22) Filed: Jan. 9, 2013

(51) Int. Cl.
*F42B 14/00* (2006.01)
*F42B 14/02* (2006.01)

(52) U.S. Cl.
CPC ..... *F42B 14/02* (2013.01)
USPC ..... 102/526

(58) Field of Classification Search
USPC ..... 102/521, 524–527
See application file for complete search history.

(56) References Cited

U.S. PATENT DOCUMENTS 2,607,645 A * 8/1952 Westerhouse ..... 277/446
2,846,281 A 8/1958 Szigeti
2,856,856 A * 10/1958 Michael ..... 102/526
3,687,079 A * 8/1972 Scollins ..... 102/526
3,726,219 A 4/1973 Bolick
4,109,582 A * 8/1978 Haep et al. ..... 102/526
4,532,868 A * 8/1985 Gleichaut et al. ..... 102/527
4,833,995 A * 5/1989 Gotz et al. ..... 102/521
4,901,623 A 2/1990 Lee
4,907,513 A 3/1990 Manion et al.
5,056,406 A 10/1991 Pinson
6,177,644 B1 * 1/2001 Wilkie et al. ..... 219/69.17
6,419,235 B1 7/2002 Han
6,782,830 B1 8/2004 Candland et al.
8,540,250 B2 * 9/2013 Sato ..... 277/371

* cited by examiner

*Primary Examiner* — Reginald Tillman, Jr.
(74) *Attorney, Agent, or Firm* — Renner, Otto, Boisselle & Sklar, LLP

(57) ABSTRACT

An obturator can be secured to a projectile to be launched from within a launch tube. The obturator cooperates with the projectile to seal a pressurized gas within the launch tube during launch. The obturator has a plurality of segments that combine to form a ring. Each segment has connecting features that cooperate with corresponding connecting features of an adjacent segment to hold the segments together by restricting relative circumferential movement, without restricting radially outward movement of individual segments. Preferably, each segment is identical, making it easier to repair and assemble the obturator. Upon launch, the obturator segments can move radially outwardly to separate into relatively small, uniformly-sized pieces.

10 Claims, 5 Drawing Sheets

OBTURATOR RING WITH INTERLOCKING SEGMENTS

FIELD OF THE INVENTION

This invention relates to an apparatus and method for sealing gas between a projectile and a launch tube during the launch of the projectile from the launch tube.

BACKGROUND

An obturator seals high pressure gas between a projectile and a wall of a launch tube. Providing a good gas seal increases the gas pressure in the launch tube, which increases the projectile's velocity at launch.

The obturator preferably falls off the projectile after the obturator exits the launch tube. Sometimes the obturator fails to release from the projectile, thereby increasing drag and weight of the projectile, and possibly unbalancing the projectile, thereby reducing its range and accuracy.

SUMMARY

The present invention provides an obturator ring that is formed of self-locking interlocking segments that create an effective gas seal when constrained in a launch tube and separate from one another and the projectile in a predictable manner and of a uniform size when they exit the launch tube behind the projectile.

More particularly, the present invention provides an obturator that can be secured to a projectile to be launched from within a launch tube, the obturator cooperating with the projectile to seal a pressurized gas within the launch tube during launch. The obturator includes two or more segments that combine to define a ring. Each segment includes connecting features that cooperate with corresponding connecting features of an adjacent segment to restrict relative circumferential movement without restricting radially outward movement of individual segments.

In an exemplary embodiment, at least two of the segments, and potentially all of the segments, are identical. The identical segments can be symmetric about a line of symmetry.

The connecting features can include interlocking arms, or a tab and a corresponding slot.

The connecting features restrict circumferential movement of the connected segments.

An exemplary obturator ring is cylindrical. Accordingly, the segments have an arcuate shape.

The obturator can be combined with a projectile, where the obturator is mounted on the projectile. The obturator further can be combined with a launch tube, where the projectile and the obturator are installed in the launch tube.

The present invention also provides an obturator with two or more segments that cooperate to define a ring, and each segment includes means for connecting to an adjacent segment to restrict relative circumferential movement without restricting radially outward movement of individual segments.

The connecting means can include connecting features on each segment that cooperate with corresponding connecting features of an adjacent segment to connect adjacent segments together.

Finally, the present invention also provides a method of making an obturator. The method includes the steps of moving a plurality of segments radially inwardly to connect adjacent segments until the segments combine to form a substantially continuous ring. The segments include connecting features that cooperate with corresponding connecting features of an adjacent segment to restrict relative circumferential movement without restricting radially outward movement of individual segments.

DETAILED DESCRIPTION

The present invention provides an obturator ring that is formed of interlocking segments that create an effective gas seal when constrained in a launch tube and separate from one another and the projectile in a predictable manner when they exit the launch tube. The term "launch tube" includes any tubular structure from which a projectile is launched, including a rocket launch tube, a missile launch tube, a gun barrel, a mortar launch tube, etc. The present invention also is applicable to other devices that move through a tubular space where it is desirable to have a seal between the device and the walls of the tube, such as a "pig" in a pipeline.

Figure 1:
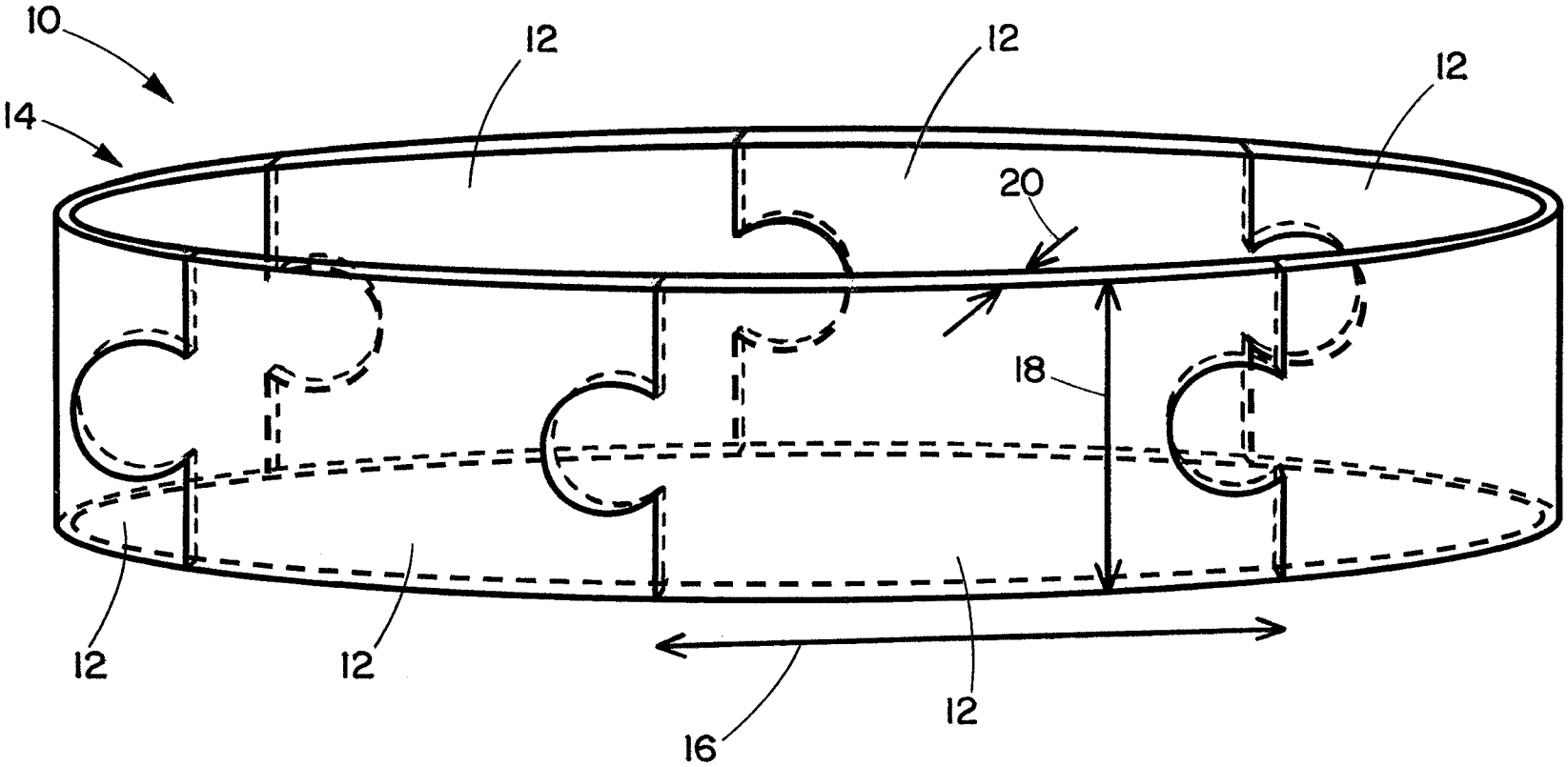
FIG. 1 is a perspective view of an exemplary obturator provided by the present invention.

An exemplary obturator 10 is shown in FIG. 1. The obturator 10 includes a two or more segments 12 joined together to form a substantially continuous ring 14. The segments 12 fit together, each segment 12 connecting with an adjacent segment 12, like the pieces of a puzzle. Each segment 12 is identical and can be connected to an adjacent segment 12, which means that the segments 12 are easier to assemble into a ring.

The material used to make the obturator segments 12 can vary from polymeric to metallic depending on use, such as the anticipated high temperature of the launch tube, the anticipated pressures, etc.

Each segment 12 has a longitudinal dimension, or length, aligned with a circumferential direction 16. The circumferential direction 16 is parallel to the circumference of the assembled ring 14. Each segment 12 also has a width dimension 18 transverse the length dimension 16, and a thickness dimension 20 generally perpendicular to the length dimension 16 and the width dimension 18. The illustrated ring 14 is cylindrical, but could also be formed by a hollow conical section. The interlocking segments 12 need to maintain a close corresponding shape relative to the inner surface of the launch tube. Accordingly, the segments 12 generally have an arcuate, nonplanar shape on at least an outer surface.

Figure 2:
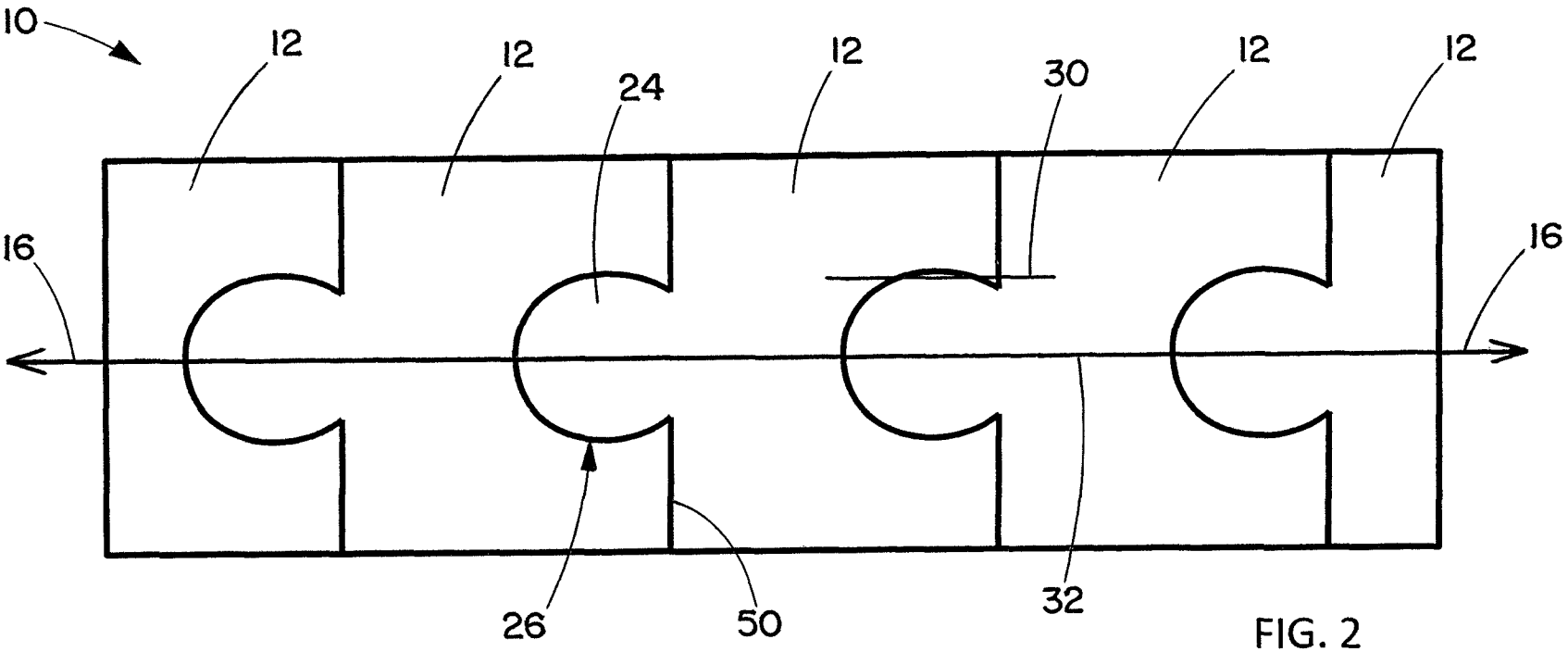
FIG. 2 is a plan view of the obturator of FIG. 1.
Figure 3:
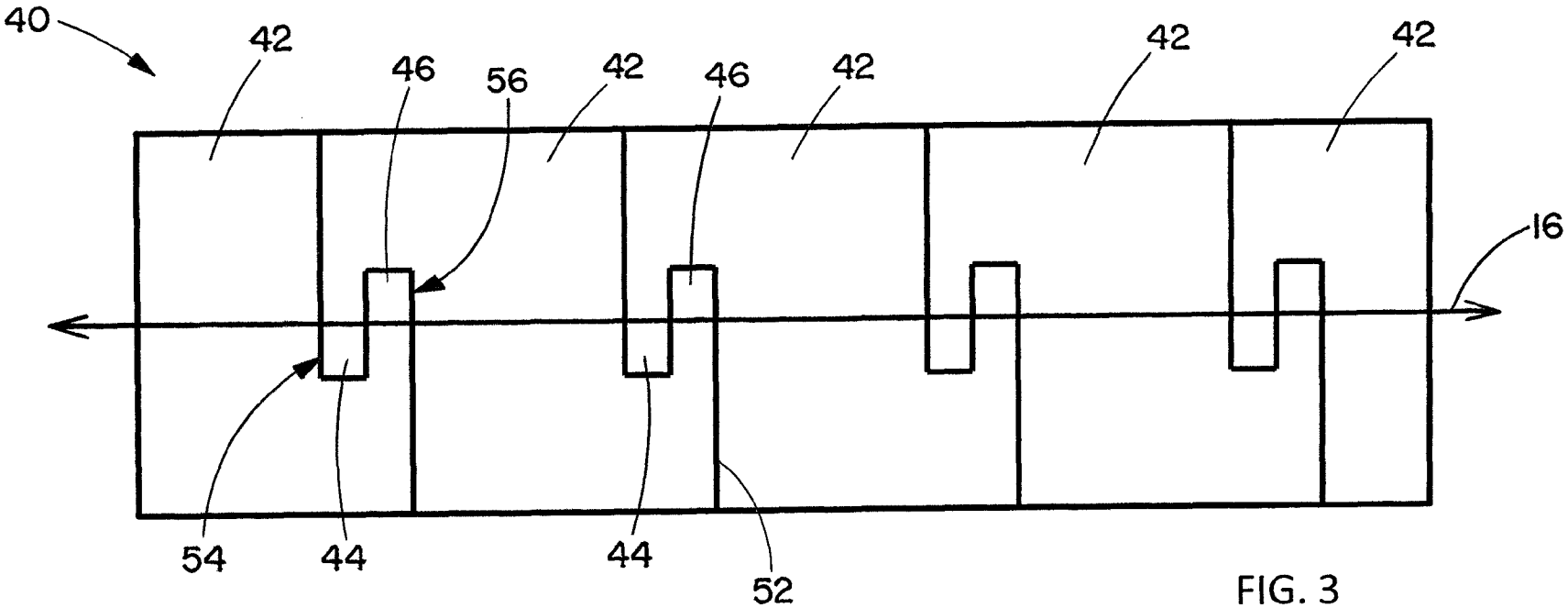
FIG. 3 is a plan view of another exemplary obturator provided by the invention.
Figure 5:
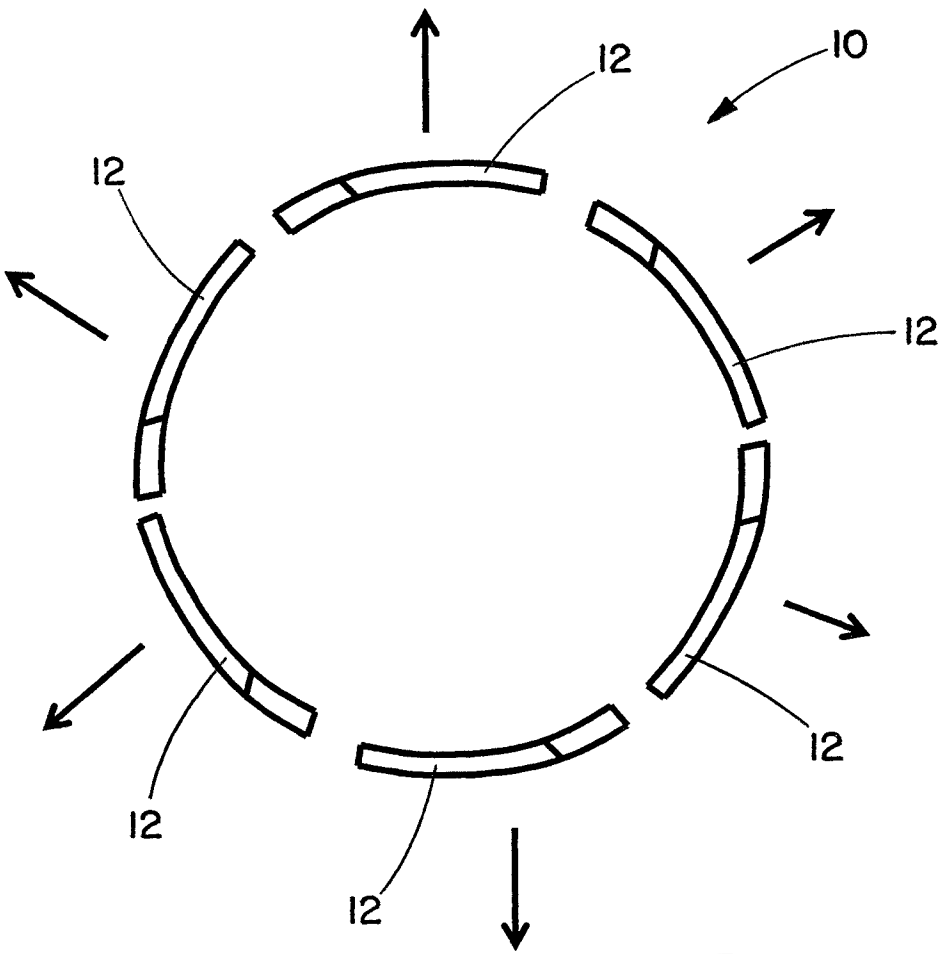
FIG. 5 is a schematic top view of the obturator of FIG. 4 illustrating the separation of individual segments.
Figure 4:
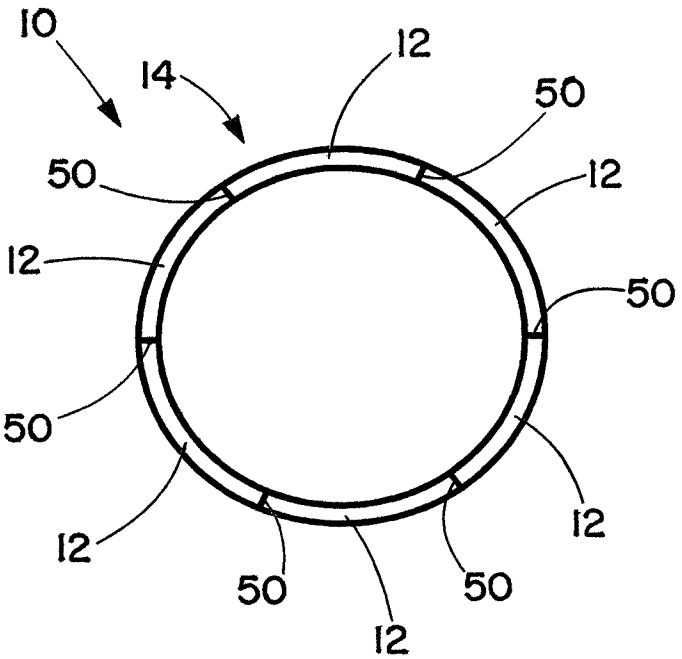
FIG. 4 is a top view of the obturator of FIG. 1.

The segments 12 have respective connecting features for connecting adjacent segments. Two variations are shown in FIGS. 2 and 3. These connecting features interlock and interfere with the connecting features of an adjacent segment to prevent the segments 12 from separating in the circumferential direction. The segments 12 are connected in a direction that is transverse the circumferential direction, generally parallel to the thickness dimension 20, a direction that corresponds to a radial direction when the ring 14 is assembled. As a result, the ring 14 is strong circumferentially, but the segments 12 readily separate when moved radially outwardly, as shown in FIGS. 4 and 5. The interlocking nature of the segments 12 also prevents the segments 12 from distorting in shape under the influence of the hot launch gases, thereby ensuring a high quality seal.

In FIG. 2, the connecting features of the obturator 10 include a bulbous tab 24 that is received in a correspondingly-shaped slot 26 in an adjacent segment. The slot 26 is a negative image of the tab 24. Similar shapes can be found in puzzle pieces. A line 30 can be drawn parallel to the circumferential direction 16, toward an edge of the tab 24, that extends through the tab 24 and a portion of the adjacent segment 12 before returning to the tabbed segment 12. The portion of the adjacent segment and the tab 24 thus interfere with each other in the circumferential direction 16 and prevent the adjacent segments 12 from separating along the circumferential direction 16. The segments 12 are symmetric about a centrally-located circumferential line of symmetry 32.

An alternative embodiment of and obturator 40 provided by the invention has a plurality of identical segments 42 with different connection features. In FIG. 3, the connecting features include interlocking arms 44 and 46 extending from respective segments 42. Unlike the segments 12 shown in FIG. 2, the segments 42 shown in FIG. 3 do not have symmetric shapes. The arms 44 and 46 on each end of each segment 42 extend in opposite directions. An upwardly-extending arm 46 of each segment 42 defines a cavity 54 between the arm and 46 the body of the segment 42. And a downwardly-extending arm 44 on an opposite side of each segment 42 defines a cavity 56 between the arm 44 and the body of the segment 42. The arm of one segment is a negative image of the cavity formed by the arm of the adjacent segment. Consequently, the arms 44 and 46 of the adjacent segments 42 can be received in respective cavities 54 and 56, tying the segments 42 together. In this example, the segments 42 move laterally (parallel to the width dimension 18 (FIG. 1)), in such a manner as to disengage their arms 44 and 46, if only two segments 42 were connected together in this manner. Once the segments 42 are connected in series to form a ring, the oppositely-extending arms 44 and 46 on the other side of the segment 42 prevent such lateral disengagement.

To permit some radial expansion of the obturator 10 or 40, the connecting features can allow a limited, restricted amount of movement between adjacent segments 12 or 42 in the circumferential direction 16. This movement can be permitted through limited flexing of the connecting features or a predetermined amount of looseness in the connection. In either case, however, the connecting features prevent the segments 12 or 42 from separating as they attempt to move away from each other in the circumferential direction 16.

At the joint between adjacent segments 12 or 42, a joint line 50 follows a convoluted path to enhance the obturator ring's gas sealing properties. As a result, even if a gap opens along a portion of the joint line 50 or 52 as the obturator ring 20 or 40 expands and the segments 12 or 42 move radially outward to fill the gap between the outer surface of the projectile and the inner surface of the launch tube, the convoluted path defined by the joint line 50 or 52 will resist gas flow therethrough.

As shown in FIG. 4, when the segments 12 are connected together, end-to-end in series, the obturator 10 forms a ring 14. The obturator 14 is assembled by moving a plurality of segments 12 radially inwardly to connect adjacent segments 12 serially, one segment 12 to an adjacent segment, until the last segment is connected to the first segment to form a substantially continuous ring 14. A plurality of segments 12 also can be connected together to form a belt, which then can be wrapped around a projectile and secured in place by connecting the segments from opposite ends of the series of segments 12 that make up the belt. The segments 12 or 42 lock together sufficiently tightly to withstand handling of the projectile without significant risk that the obturator 10 or 40 would separate from the projectile prior to launch. The assembled segmented ring 14 (FIG. 1) also can be heated during assembly or before assembly on the projectile to further ensure that the segments 12 stay connected together. As shown in FIG. 5, the segments 12 readily separate as they each move radially outward.

Figure 6:
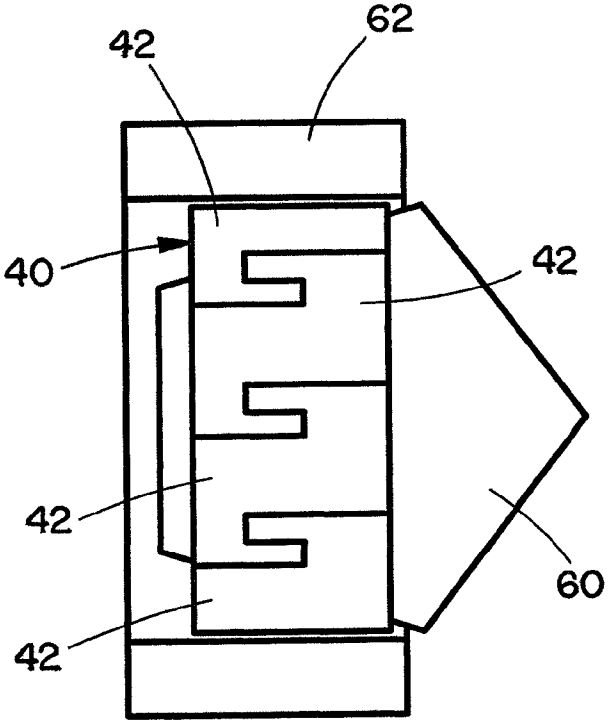
FIG. 6 is a schematic illustration of the obturator of FIG. 3 mounted on a projectile in a launch tube, the launch tube constraining the obturator to provide a gas seal between the projectile and the launch tube.

FIG. 6 shows an obturator 40 provided by the invention assembled on a schematic projectile 60 within a launch tube 62. Upon launch, hot gases generated by the launch or centrifugal force generated during the launch cause the obturator ring 40 to radially expand and the segments 42 move radially outward to seal a gap between the projectile 60 and an inner wall of the launch tube 62, trapping the hot gases generated at launch within the launch tube 62. A projectile can be made to spin by a launch tube with a rifled bore or features of the projectile designed to induce spin about a longitudinal axis. A spinning projectile generally will move along a straighter path. The expansion of the obturator 40 is restricted by the inner surface of the launch tube 62, which ensures that the obturator 40 maintains an effective seal between the inner surface of the launch tube 62 and the outer surface of the projectile 60. In fact, the obturator 40 engraves into the inside surface of the launch tube 62 during launch, ensuring a tight seal.

Figure 7:
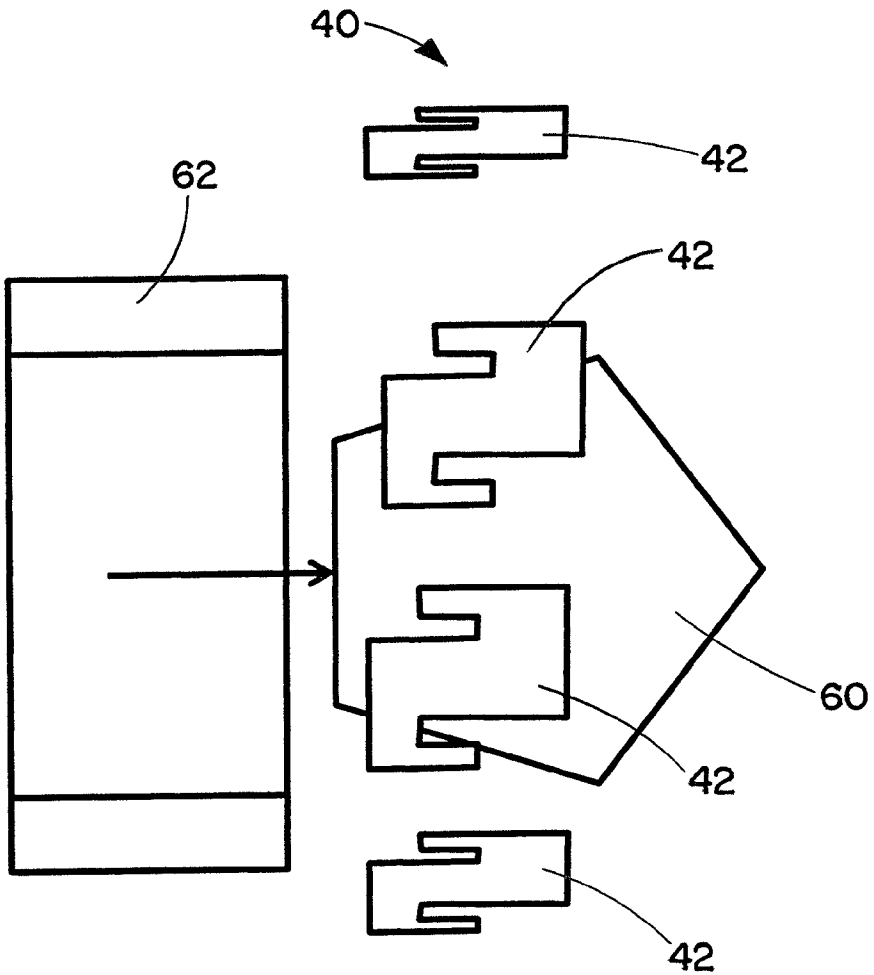
FIG. 7 is a schematic illustration of the obturator of FIG. 6 showing the well-ordered separation of the obturator segments as the projectile exits the launch tube.

The hot gases remain trapped behind the obturator 40 until the obturator 40 escapes the launch tube 62, thereby maximizing the transfer of energy from the hot gases to the projectile 60. Once the obturator 40 exits the launch tube 62, the inside surface of the launch tube 62 no longer restricts the outward movement of the obturator segments 42. So as the obturator 40 exits the launch tube 62 the captive launch gases or centripetal force will cause the segments 42 to move radially outward and separate from one another and the projectile 60, as illustrated in FIGS. 5 and 7.

The controlled failure of the obturator in this manner generally causes the obturator to separate from the projectile into a plurality of relatively small segments of uniform size. The small, uniformly-sized segments minimize the chance of a mass imbalance as the segments separate from the projectile.

The obturator thus shown and described can be installed and replaced in the field, thereby simplifying the projectile manufacturing process and allowing projectiles to be outfitted with obturators in the field, including retrofitting projectiles to accommodate the obturator provided by the present invention.

In summary, an obturator 10, 40 can be secured to a projectile 60 to be launched from within a launch tube 62. The obturator 10, 40 cooperates with the projectile 60 to seal a pressurized gas within the launch tube during launch. The obturator 40 has a plurality of segments 12, 42 that combine to form a ring 14. Each segment 12, 42 has connecting features that cooperate with corresponding connecting features of an adjacent segment 12, 42 to hold the segments 12, 42 together by restricting relative circumferential movement, without restricting radially outward movement of individual segments 12, 42. Preferably, each segment 12, 42 is identical, making it easier to repair and assemble the obturator 10, 40.

Upon launch, the obturator segments 12, 42 can move radially outwardly to separate into relatively small, uniformly-sized pieces.

Although the invention has been shown and described with respect to a certain illustrated embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the illustrated embodiments of the invention.

What is claimed is:

1. An obturator that can be secured to a projectile to be launched from within a launch tube, the obturator cooperating with the projectile to seal a pressurized gas within the launch tube during launch, the obturator comprising:

two or more segments that combine to define a ring;

where each segment includes connecting features that cooperate with corresponding connecting features of an adjacent segment to restrict relative circumferential and transverse movement of adjacent segments away from one another without restricting radially outward movement of individual segments.

2. An obturator as set forth in claim 1, where at least two of the segments are identical.

3. An obturator as set forth in claim 2, where the identical segments are symmetric about a line of symmetry.

4. An obturator as set forth in claim 1, where the connecting features include interlocking arms.

5. An obturator as set forth in claim 1, where the connecting features include a tab and a corresponding slot.

6. An obturator as set forth in claim 1, where the ring is cylindrical.

7. An obturator as set forth in claim 1, where the segments have an arcuate shape.

8. An obturator as set forth in claim 1, in combination with a projectile, where the obturator is mounted on the projectile.

9. A combination as set forth in claim 8, in combination with a launch tube, where the projectile and the obturator are installed in the launch tube.

10. A method of making an obturator that can be secured to a projectile to be launched from within a launch tube, comprising the steps of moving a plurality of segments radially inwardly to connect adjacent segments until the segments combine to form a substantially continuous ring, where the segments include connecting features that cooperate with corresponding connecting features of an adjacent segment to restrict relative circumferential and transverse movement of adjacent segments away from one another without restricting radially outward movement of individual segments.

* * * * *